US008631902B2

(12) United States Patent
Crook

(10) Patent No.: US 8,631,902 B2
(45) Date of Patent: Jan. 21, 2014

(54) APPARATUS FOR ELEVATING AND POSITIONING A WORK PLATFORM

(75) Inventor: Gary Crook, Selma, CA (US)

(73) Assignee: California Manufacturing & Engineering Co., Kerman, CA (US)

( * ) Notice: Subject to any disclaimer, the term of this patent is extended or adjusted under 35 U.S.C. 154(b) by 276 days.

(21) Appl. No.: 12/616,350

(22) Filed: Nov. 11, 2009

(65) Prior Publication Data

US 2010/0170747 A1 Jul. 8, 2010

Related U.S. Application Data

(60) Provisional application No. 61/204,585, filed on Jan. 8, 2009.

(51) Int. Cl.
*E04G 3/28* (2006.01)

(52) U.S. Cl.
USPC ..... 182/2.11; 182/2.1; 182/2.3

(58) Field of Classification Search
USPC ..... 182/2.11, 69.6, 2.1, 2.9, 63.1, 2.6, 141
See application file for complete search history.

(56) References Cited

U.S. PATENT DOCUMENTS

| | | | | |
|---|---|---|---|---|
| 3,190,391 | A * | 6/1965 | Hoard | 182/2.2 |
| 3,709,322 | A * | 1/1973 | Mitchell | 182/62.5 |
| 3,834,488 | A * | 9/1974 | Grove | 182/2.11 |
| 3,893,540 | A * | 7/1975 | Beucher | 182/2.9 |
| 4,019,604 | A | 4/1977 | Benson | |
| 4,271,926 | A * | 6/1981 | Cullity | 182/2.1 |
| 4,456,093 | A * | 6/1984 | Finley et al. | 182/2.2 |
| 4,511,015 | A * | 4/1985 | Purdy | 182/2.11 |
| 4,690,247 | A * | 9/1987 | Yoshida | 182/2.6 |
| 4,757,875 | A * | 7/1988 | Hade et al. | 182/2.7 |
| 4,775,029 | A * | 10/1988 | MacDonald et al. | 182/2.1 |
| 5,082,085 | A | 1/1992 | Ream et al. | |
| 5,159,989 | A | 11/1992 | Claxton | |
| 5,269,393 | A | 12/1993 | Luscombe | |

(Continued)

FOREIGN PATENT DOCUMENTS

| | | | |
|---|---|---|---|
| DE | 4120584 | A1 | 12/1992 |
| EP | 0525903 | A1 | 2/1993 |

(Continued)

OTHER PUBLICATIONS

Definition of 'Planar' provided in RCE non-final The American Heritage® Dictionary of the English Language, Fourth Edition copyright © 2000 by Houghton Mifflin Company. Updated in 2009. Published by Houghton Mifflin Company. All rights reserved.*

Manitou Maniaccess 150P brochure (2007).

Nagano Industry Co. Ltd. NUL Series NUZ090D brochure (2007).

*Primary Examiner* — Katherine Mitchell
*Assistant Examiner* — Daniel Cahn
(74) *Attorney, Agent, or Firm* — W. Norman Roth

(57) ABSTRACT

Apparatus for elevating, laterally and rotationally positioning an aerial work platform relative to a support structure such as a mobile vehicle. In one embodiment a platform supporting carriage is mounted for sliding movement along a support beam affixed to a boom and the platform is mounted on the carriage permitting rotation of the platform about a substantially vertical axis. In a second embodiment a four bar linkage is used for longitudinally moving a rotatable platform. One or more powered means may be provided for elevating, leveling and longitudinally and rotationally positioning the work platform.

5 Claims, 7 Drawing Sheets

(56) References Cited

U.S. PATENT DOCUMENTS

| | | | | |
|---|---|---|---|---|
| 5,427,197 | A * | 6/1995 | Waters | 182/2.9 |
| 5,868,218 | A * | 2/1999 | Lawson | 182/69.6 |
| 5,913,379 | A * | 6/1999 | Young et al. | 182/2.7 |
| 6,119,882 | A | 9/2000 | Crook et al. | |
| 6,488,161 | B1 * | 12/2002 | Bean | 212/300 |
| 7,246,684 | B2 * | 7/2007 | Bean | 187/224 |
| 7,448,470 | B2 * | 11/2008 | Brown et al. | 182/63.1 |

FOREIGN PATENT DOCUMENTS

| | | | |
|---|---|---|---|
| EP | 1491489 | A2 | 12/2004 |
| FR | 2266656 | A1 | 10/1975 |
| FR | 2626865 | A1 | 8/1989 |
| FR | 2701940 | A1 | 9/1994 |

* cited by examiner

APPARATUS FOR ELEVATING AND POSITIONING A WORK PLATFORM

CROSS REFERENCE TO RELATED APPLICATIONS, IF ANY

This application claims priority from Provisional application Ser. No. 61/204,585 filed Jan. 8, 2009

BACKGROUND OF THE INVENTION AND PRIOR ART

1. Field of the Invention

This disclosure pertains to aerial deck and work platforms which are mounted on single or multi-section telescopic or articulated booms to position the platform at a selected elevation and position relative to a chassis or other support structure. More specifically, the disclosure pertains to apparatus which is more efficiently able to position large sized work platforms with telescopic booms although articulated booms can also be used instead.

2. Description of the Related Art

Boom mounted work platforms are typically of rectangular configuration and, frequently, it is desirable to position the long side of the rectangular platform in close proximity to a vertical wall or to the vertical edge of a horizontal deck. Ideally, this should be easily accomplished without having to reposition an entire mobile vehicle on which the boom and work platform is supported.

One prior art example of a telescopic boom having a large work platform non-rotatably supported thereon is the Manitou 150 TP which has a relatively short platform supported slide out deck which overlaps the main deck of the platform when the slide out deck is retracted.

A second example of known prior art is the Nagano NUZ090D device in which a rectangular work platform of about 7 feet by 10.5 feet is mounted at the upper end of a telescopic boom for rotation about a vertical axis relative to the boom. Although the platform can be rotated, it cannot be laterally translated relative to the boom. The long sides of the work platform in this device are ordinarily aligned parallel to the longitudinal axis of the mobile support on which the boom is mounted.

Rotation of a large work platform relative to the boom creates very large torsional forces on the supporting boom which require substantial additional structural strength. The prior art platforms have therefore been limited in size by either using a rotatable platform while ensuring that the vertical axis of rotation of the platform is not located too far from a centered position over a mobile support structure or by merely precluding rotation of the platform relative to the boom and using a small slidable deck instead.

A more efficient arrangement is desired which is capable of longitudinal and rotational positioning for large workloads and in which the work platform and supporting boom may be closely positioned and stowed over the support structure, usually a mobile wheeled vehicle, during movement to different work locations.

SUMMARY OF THE INVENTION

In a first embodiment, the present invention provides apparatus for elevating and positioning a work platform comprising a support structure which can comprise a mobile vehicle or chassis and a boom which may be telescopic connected to said support structure. The boom has a platform support end and a platform support beam pivotally connected to the platform support end of the boom. A first powered means is connected to the platform support beam and boom for maintaining the platform support beam in a substantially horizontal position during elevation and lowering of said boom. A carriage is mounted for sliding movement along the support beam and a platform is mounted on the carriage in a manner permitting rotation of the platform about a substantially vertical axis. Second powered means are provided for longitudinally moving the carriage and platform to different positions along the support beam and third powered means are provided for rotating the platform about a substantially vertical axis.

In a second embodiment the apparatus for lifting and positioning a work platform comprises a preferably mobile support structure having a telescopic boom connected to the support structure, the boom having a platform support end. A four bar linkage is pivotally connected to the platform support end of the boom in a manner permitting the four bar linkage to be closely positioned above the boom. A work platform bearing is affixed to the four bar linkage and to the platform to permit rotation of the platform about a substantially vertical axis. First powered means are connected to the four bar linkage and boom for maintaining the platform in a substantially horizontal position during elevation and lowering of the platform and boom; second powered means are provided for adjusting the four bar linkage to laterally move the platform support to different positions and third powered means are provided for rotating said platform about the substantially vertical axis

DESCRIPTION OF THE PREFERRED EMBODIMENTS

Figure 1:
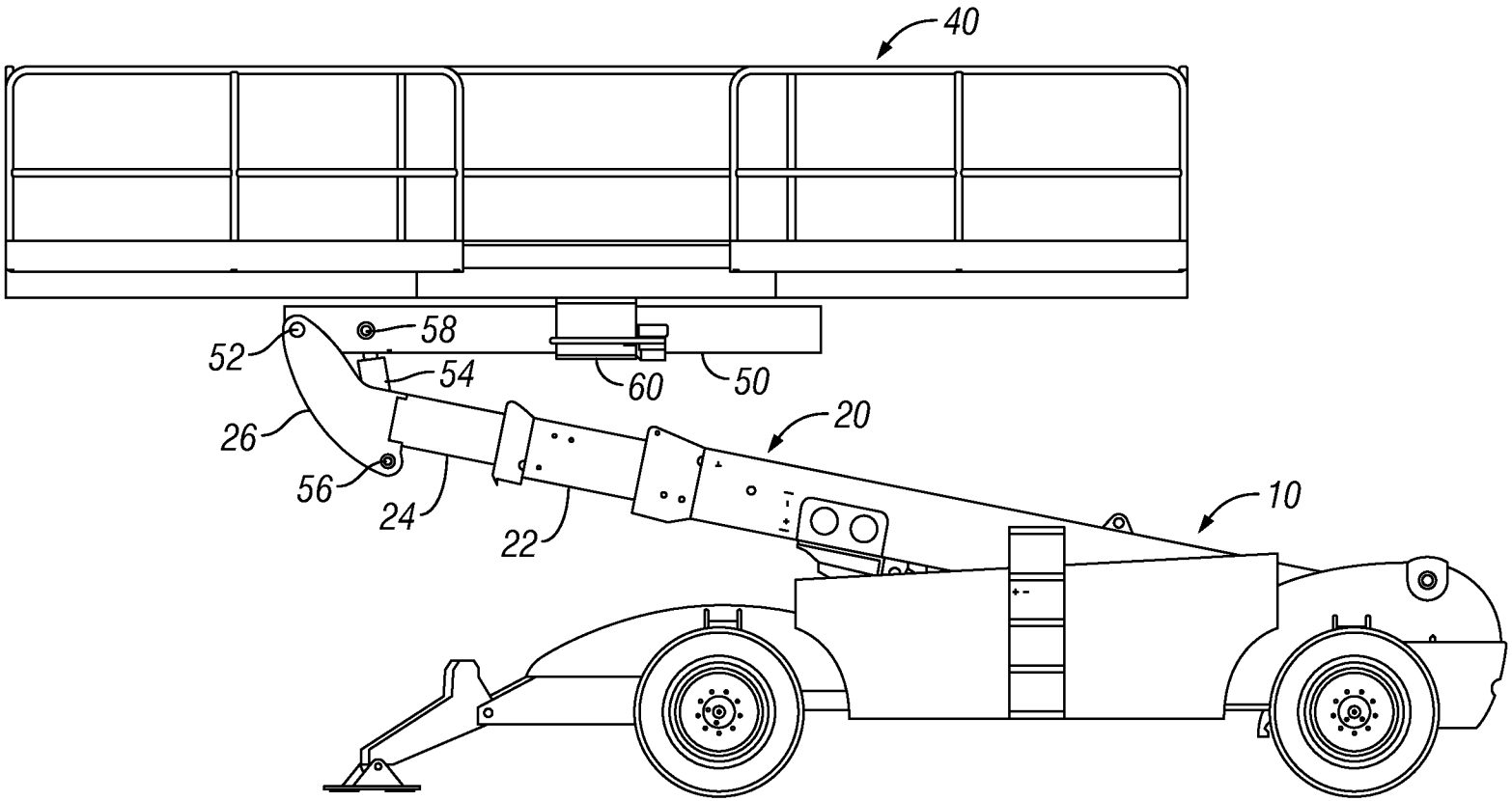
FIG. 1 is a schematic side elevation view of a first embodiment of an apparatus for elevating and positioning a work platform and a large work platform.

As seen in FIG. 1, the apparatus includes a support structure 10. Preferably, the support structure 10 is a mobile vehicle which, as shown, may be a wheeled vehicle or a tracked vehicle. Such a vehicle may be motor driven or otherwise moveable to a desired position at a work location. A boom 20, preferably telescopic and having one or more extendable boom sections 22, 24, is mounted on the support structure 10 by a pivotal connection 30 (FIG. 4) which permits angular movement of the boom relative to the support structure about a substantially horizontal axis. As shown in the drawings, a rectangular work platform 40 which may be elevated and laterally positioned relative to the boom 20 is shown above a platform support beam 50. As will be appreciated by those skilled in the art, the platform support beam 50 may take any structurally suitable configuration such as an I-beam, box beam, channel or other shape.

As shown, the boom 20 may include a boom top bracket 26 suitably configured for pivotal connection of the platform support beam 50 to the boom top bracket 26 by a pivotal connection shown at 52. A first powered means 54 is connected to the platform support beam 50 and to the boom 20 at the end bracket 26 for maintaining the platform support beam 50 in a substantially horizontal position during elevation and lowering of the boom 20. In the embodiment shown in FIG. 1, the first powered means 54 is depicted as a piston/cylinder unit having a pivotal connection 56 to the boom bracket 26 and a second pivotal connection 58 to the slider beam 50 as shown. Although the first powered means 54 shown in the drawings comprises a piston/cylinder unit which may be hydraulic or pneumatic, the first powered means can of course take other forms such as a motor and transmission connected between the boom 20 and the support beam 50 operably functioning to maintain the support beam 50 in a generally level horizontal orientation as workers and/or equipment are being elevated and lowered on the platform 40 by elevation and lowering of the boom which by either or a combination of the angular adjustment of the boom about the pivot 30 and extension or retraction of one or more of the boom sections 22, 24.

A carriage 60 is mounted on the support beam 50 in a manner permitting longitudinal movement of the carriage 60 between limits of travel along the length of the support beam 50. The carriage 60 may be supported on the beam 50 in any suitable fashion such as by rollers (not shown) which ride along a suitable surface or surfaces of the support beam 50 which have a horizontal extent such as a top surface or lower of the support beam 50 or upper faces of horizontally extending flanges on the support beam 50.

A work platform 40 is rotatably connected to the carriage 60 using a bearing arrangement postioned at a location preferably, but not essentially, at or near of the geometric center of the platform in a manner to permit rotation of the platform 40 about a substantially vertical axis. The bearing may be connected to the platform 40 and carriage 60 by any suitable means such as threaded connectors or welding.

Figure 3:
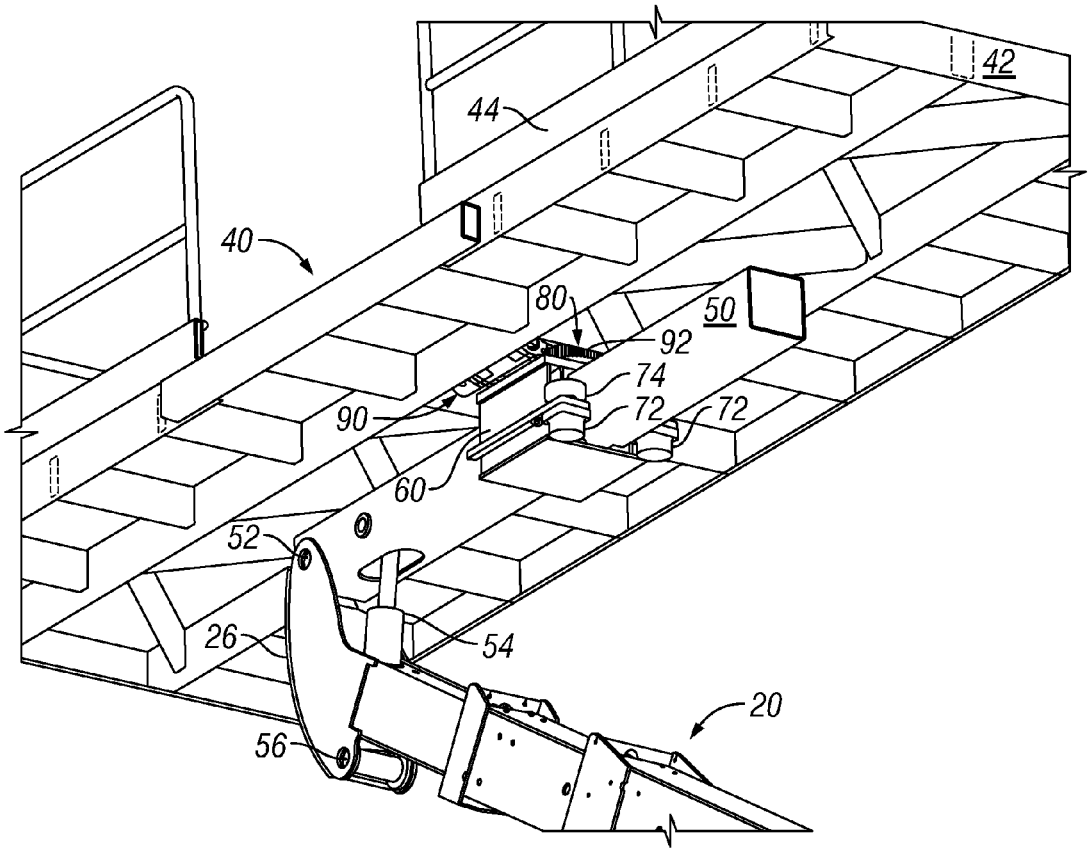
FIG. 3 is a perspective view of the underside of the platform in an elevated position showing a platform support carriage positioned on a platform support beam.

In FIG. 3, a second powered means is mounted on the carriage 60 for longitudinally moving the carriage to different positions along the support beam 50. As shown, the second powered means includes a hydraulic motor or motors 72 for driving a pinion gear or gears suitable for engaging a rack gear or rack gears mounted on the support beam 50 to move the carriage 60 longitudinally along the support beam as desired. As will be appreciated by those skilled in the art, suitable control of the second powered means, accessible by personnel on the work platform 40 will be provided. The details of the carriage positioning control are not shown and may be easily provided by those with reasonable skill in the art.

Also shown in FIG. 3 is a third powered means, generally indicated at 90, for rotating the platform 40 about a substantially vertical axis when desired. The third powered means 90 may comprise a motor and transmission of any suitable type, preferably hydraulic. In the presently preferred arrangement shown in FIG. 4, the transmission includes a drive gear (not shown) engageable with a driven gear shown at 92. The third powered means 90 for rotating the platform relative to the carriage should also be controllable by personnel on the work platform 40 whereby personnel on the work platform 40 can both rotate the platform about a substantially vertical axis relative to the platform support beam 50 and laterally position the platform 40 at selected working locations relative to the platform support beam 50. This enables workers to rotate and translate the platform as desired such that the long side of the platform may be positioned outwardly well beyond the footprint of the support structure 10 underneath. In many job sites, it is impossible or highly difficult to position a work platform close enough to a vertical wall other than by placing the longitudinal axis of the vehicle parallel and close to the wall. This is particularly true if the boom is telescopic and is mounted on the support vehicle for rotation only around a horizontal axis transverse to the vehicle length. The structure disclosed herein can easily accommodate a very large platform of approximately 7.5 feet by 22 feet which can rotate relative to the telescopic boom on which it is supported to present a long side to the work area when desired and hence allow the support vehicle to approach the work at any angle. Significantly larger loads (typically twice the capacity of existing machines) can be supported on a large platform that can be rotated, without imparting substantial torsional loads into the telescopic boom structure.

As is conventional, the boom 20 is angularly elevated and lowered relative to the support structure 10 by a fourth powered means 100 which, as shown, is in the form of a hydraulic piston/cylinder arrangement. As will be appreciated by those skilled in the art, although the fourth powered means 100 is depicted as a hydraulic piston/cylinder unit, it should be apparent that the fourth powered means 100 can take any other suitable form for achieving the intended purpose, such as a pneumatic piston/cylinder unit, and electric or fluid driven motor/transmission units and others. Also, as will be appreciated by those skilled in the art, a fifth powered means (not shown) will be provided for extending and retracting the extensible sections 22, 24 of the telescopic boom 20.

Figure 2:
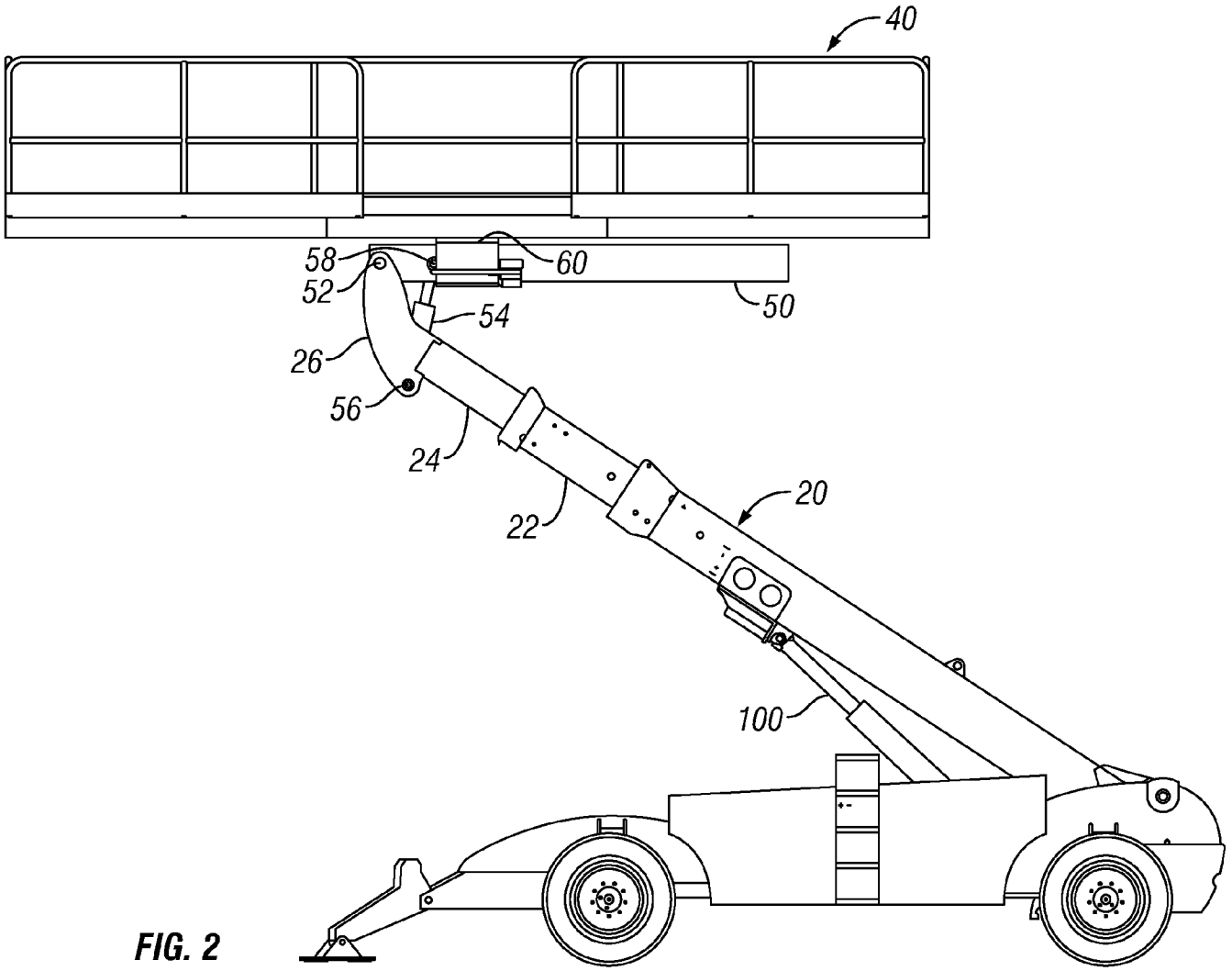
FIG. 2 is a view similar to FIG. 1 but showing the platform elevated to a working location.
Figure 4:
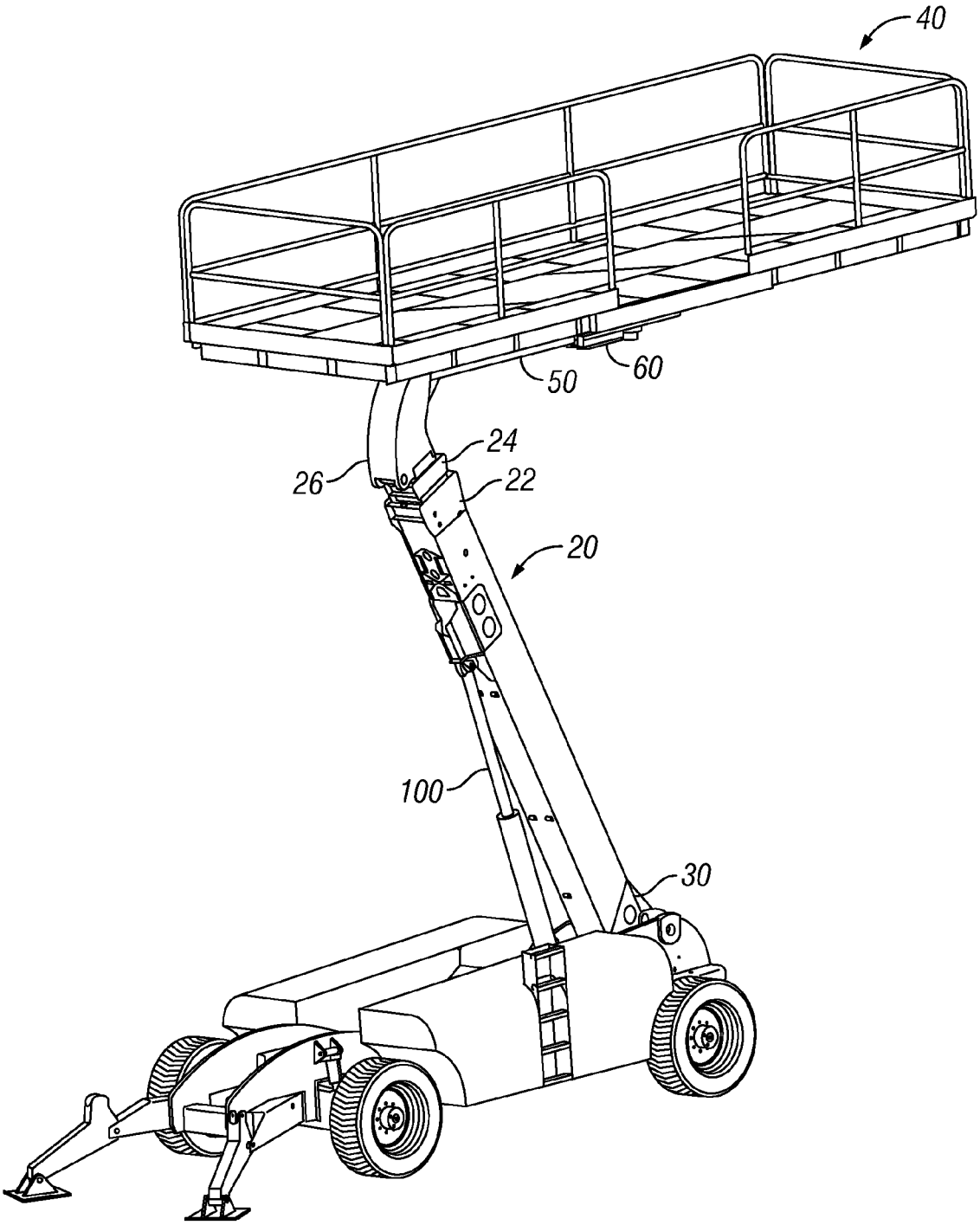
FIG. 4 is a perspective view showing the platform in elevated position in-line with the chassis.
Figure 5:
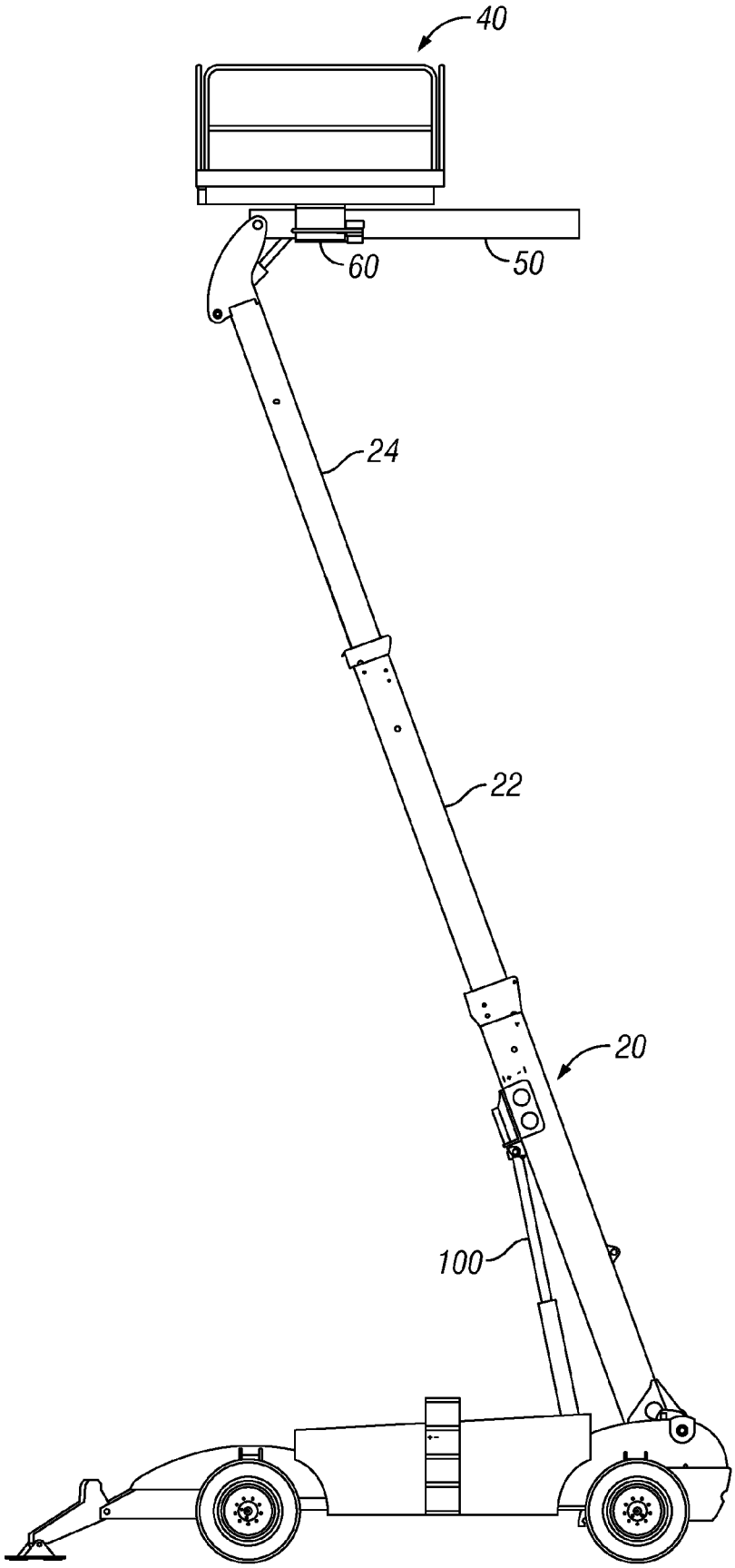
FIG. 5 is a side elevation view showing the platform in elevated position with the platform rotated to present the long side of the platform in the front direction.

In FIG. 1, a long side 44 of the rectangular platform 40 is generally aligned with the longitudinal axis of the boom 20 and support 10, the boom and platform being substantially lowered toward and near a full lowered position in which the platform will be centered above the boom which is aligned with and above the support structure for transport or storage. FIG. 2 is similar to FIG. 1 but shows the extensible sections 22, 24 of the boom 20 slightly extended and with the platform 40 positioned on the support beam 50 near the far left end limit of its travel along the support beam 50. FIG. 4 is similar to FIG. 1 but shows the boom 20 in an angularly elevated position with a short side 42 of the platform positioned parallel to the longitudinal axis of the support structure and with the support platform 40 near the right end limit of its travel along the support beam 50. FIG. 5 is similar to FIG. 4 but shows a long side 44 of the platform 40 extending parallel to the longitudinal axis of the support structure 10.

Figure 6:
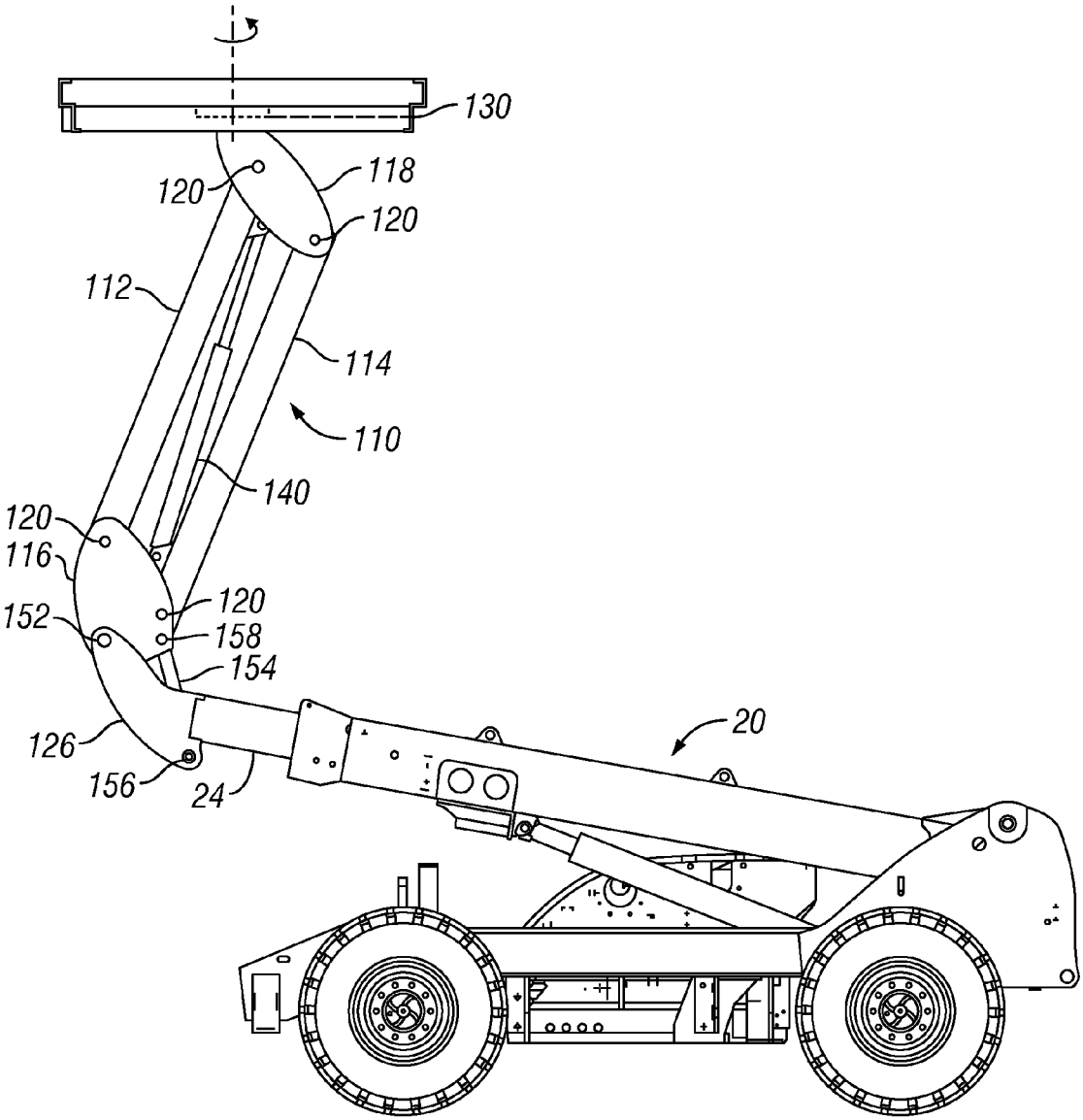
FIG. 6 is a side elevation view of a second embodiment employing a four bar linkage for translating the platform beyond the end of the boom.
Figure 7:
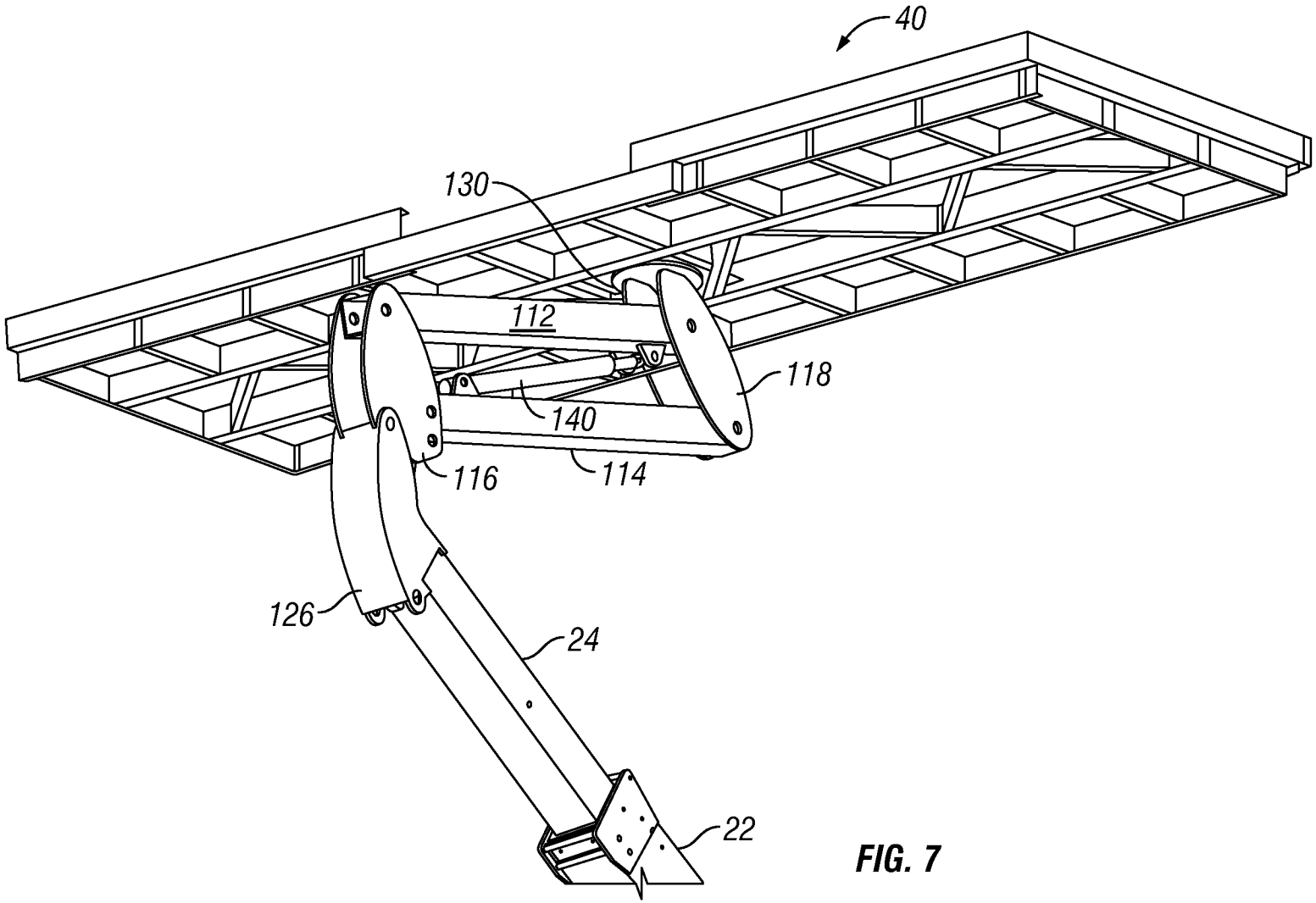
FIG. 7 is a perspective view of the underside of the platform of FIG. 6.

FIGS. 6 and 7 depict a second embodiment of apparatus for elevating and rotationally and longitudinally positioning a work platform. In the embodiment of FIGS. 6 and 7, a four bar linkage 110 replaces the platform support beam 50 and carriage 60 arrangement for longitudinally repositioning the platform 40 relative to the boom 20. The four bar linkage is comprised of spaced long bars 112 and 114 pivotally connected at their ends to spaced short bars 116 and 118, the pivotal connections of the four bars to each other being shown at 120. Short bar 116 of the four bar linkage is pivotally connected at 152 to end bracket 126 of the boom. A rotatable platform bearing 130 preferably located at or near the geometric center of the platform 40 is affixed to the platform 40 and to or near the upper end of the second support bar 118 to permit rotation of the platform 40 about a vertical axis to alternatively present a short or a long side of the rectangular work platform to a work area when desired. As described with reference to the first embodiment, a powered means (not shown) preferably is provided for powered rotation of the platform as desired.

A first powered means 154 similar to the first powered means 54 of the first embodiment, shown in the form of a piston/cylinder unit, is pivotally connected at 156 to the boom end bracket 126 and to the four bar linkage at 158 to maintain the platform 40 in a substantially horizontal orientation at all relevant times. A second powered means 140, shown in the form of a piston/cylinder unit having opposite ends pivotally connected near and to opposite ends of the long bars 112, 114 of the four bar linkage is provided for laterally translating the platform 40 relative to the boom. As in the first embodiment, a suitable control arrangement may be provided so that the platform 40 can be longitudinally and rotationally positioned by personnel on the platform by controlling the rotary connection 130 and the translating piston/cylinder unit 140.

Various modifications of the embodiments of the invention shown and described above may be made without departing from the scope of the invention which is defined by the claims which follow.

The invention claimed is:

1. Apparatus for elevating and positioning a work platform, said apparatus comprising:

a) a mobile support structure;

b) an extensible boom connected to said support structure for pivotal movement about a substantially horizontal axis extending transversely to said support structure, said boom having a platform support end;

c) an elongated platform support beam having a longitudinal axis which remains in a substantially horizontal orientation connected to said platform support end of said boom and a piston and cylinder unit connected to said platform support beam and connected to said boom, said piston and cylinder unit maintaining said platform support beam in said substantially horizontally extending orientation during said pivotal movement and during an elevation and lowering of said boom;

d) a carriage mounted for sliding movement on said support beam to horizontally spaced positions above said boom;

e) a motor for moving said carriage to said horizontally spaced positions; and f) a platform having an upper surface, said platform mounted on said carriage for rotation of said platform about a substantially vertical axis which extends through said carriage and said boom and is located at a geometric center of said upper surface of said platform.

2. The apparatus of claim 1, wherein said piston and cylinder unit comprises a hydraulic piston and cylinder unit.

3. The apparatus of claim 1 wherein said support structure is a mobile chassis having a longitudinal axis and said boom is connected to said chassis by a pivotal connection for rotation of said boom about said substantially horizontal axis.

4. The apparatus of claim 3, further comprising powered means for moving said boom about said horizontal axis.

5. the apparatus of claim 1, wherein said platform is substantially rectangular.

* * * * *